US010913468B2

(12) United States Patent
Drexler et al.

(10) Patent No.: US 10,913,468 B2
(45) Date of Patent: Feb. 9, 2021

(54) RAIL VEHICLE HAVING A FUEL TANK

(71) Applicant: SIEMENS MOBILITY GMBH, Munich (DE)

(72) Inventors: Stephan Drexler, Sauerlach (DE); Joerg Melde, Olching (DE); Lars Mueller, Limbach (DE); Hannes Peer, Munich (DE); Guenther Proell, Augsburg (DE)

(73) Assignee: Siemens Mobility GmbH, Munich (DE)

( * ) Notice: Subject to any disclaimer, the term of this patent is extended or adjusted under 35 U.S.C. 154(b) by 274 days.

(21) Appl. No.: 16/086,023

(22) PCT Filed: Mar. 2, 2017

(86) PCT No.: PCT/EP2017/054862
§ 371 (c)(1),
(2) Date: Sep. 18, 2018

(87) PCT Pub. No.: WO2017/167536
PCT Pub. Date: Oct. 5, 2017

(65) Prior Publication Data

US 2020/0290654 A1 Sep. 17, 2020

(30) Foreign Application Priority Data

Mar. 31, 2016 (DE) ..... 10 2016 205 351

(51) Int. Cl.
*B61F 1/14* (2006.01)
*B61C 17/02* (2006.01)

(52) U.S. Cl.
CPC ..... *B61F 1/14* (2013.01); *B61C 17/02* (2013.01)

(58) Field of Classification Search
CPC ..... B61F 1/00; B61F 1/06; B61F 1/08; B61F 1/1214; B61C 3/00; B61C 17/02; B60K 15/03; B60K 15/03006; B60K 2015/03059; B60K 2015/03105; B60K 2015/03309; B60K 2015/0636; B60K 2015/0631
See application file for complete search history.

(56) References Cited

U.S. PATENT DOCUMENTS 1,814,893 A 7/1931 Burkhardt
5,410,779 A 5/1995 Esman et al.
(Continued)

FOREIGN PATENT DOCUMENTS

CN 2752119 Y 1/2006
CN 200995684 Y 12/2007
(Continued)

*Primary Examiner* — Mark T Le
(74) *Attorney, Agent, or Firm* — Laurence Greenberg; Werner Stemer; Ralph Locher

(57) ABSTRACT

A rail vehicle includes a fuel tank having a tank wall delimiting a tank interior space for storing fuel. At least portions of a first support are connected to the tank wall. A longitudinal support includes first and second longitudinal support portions being offset in longitudinal direction of the vehicle. The fuel tank is disposed in longitudinal direction between the first and second longitudinal support portions. The first support is coupled to the first and second longitudinal support portions. At least portions of the first support are disposed in the tank interior space in the longitudinal direction. The first support running in the longitudinal direction is disposed between the first and second longitudinal support portions. The first support is configured for fully transmitting a force acting between the first and second longitudinal support portions in longitudinal direction of the vehicle.

14 Claims, 9 Drawing Sheets

(56) References Cited

U.S. PATENT DOCUMENTS

| | | | | |
|---|---|---|---|---|
| 5,577,630 | A * | 11/1996 | Blair | B60K 15/03006 220/581 |
| 5,673,939 | A * | 10/1997 | Bees | B60K 1/04 280/831 |
| 5,890,740 | A | 4/1999 | Kami | |
| 6,293,364 | B1 | 9/2001 | Anderson et al. | |
| 7,077,065 | B2 * | 7/2006 | Tremblay | B60B 11/02 105/72.2 |
| 7,189,040 | B2 * | 3/2007 | Sharp | B60R 19/02 410/42 |
| 2014/0166664 | A1 * | 6/2014 | Lin | B60K 15/03006 220/562 |

FOREIGN PATENT DOCUMENTS

| | | | |
|---|---|---|---|
| CN | 202243506 | U | 5/2012 |
| CN | 202879494 | U | 4/2013 |
| CN | 203358605 | U | 12/2013 |
| CN | 203876765 | U | 10/2014 |
| CN | 204641743 | U | 9/2015 |
| CN | 105172806 | A | 12/2015 |
| CN | 204871011 | U | 12/2015 |
| CN | 205034120 | U | 2/2016 |
| DE | 2461419 | A1 | 7/1976 |
| EP | 1391562 | A1 | 2/2004 |
| SU | 1572882 | A1 | 6/1990 |

* cited by examiner (A-A)

(B-B)

RAIL VEHICLE HAVING A FUEL TANK

BACKGROUND OF THE INVENTION

Field of the Invention:

The invention relates to a rail vehicle having a longitudinal support and a fuel tank, wherein the fuel tank has a tank wall and at least one first support, the tank wall delimits a tank interior space for storing a fuel, the first support is connected to the tank wall at least in portions, the longitudinal support includes a first longitudinal support portion and a second longitudinal support portion that is disposed so as to be offset in the longitudinal direction of the rail vehicle, the fuel tank is disposed in the longitudinal direction between the first longitudinal support portion and the second longitudinal support portion, and the first support is coupled to the first longitudinal support portion and the second longitudinal support portion.

A diesel-electric locomotive is known, wherein the diesel-electric locomotive comprises a drive unit having a drive motor that is configured as an internal combustion engine, and a generator, wherein the generator is connected to the drive motor in a torque-fitting manner. The diesel-electric locomotive furthermore comprises a fuel tank. The fuel tank of diesel-electric locomotives has a particularly large storage volume in order to ensure a large range of the diesel-electric locomotive. In the event of an accident the fuel herein can escape in large quantities and contaminate the soil.

A construction machine having a frame and a tank, wherein the tank is accommodated in the frame is furthermore known from EP 1 391 562 A1.

A compact loader having a frame and a drive, wherein the drive is fastened to the frame is known from U.S. Pat. No. 6,293,364 B1.

A motor vehicle having a frame and a fuel tank, wherein the fuel tank is fastened to the frame is known from U.S. Pat. No. 5,890,740.

A fuel tank for a diesel locomotive is known from CN 202243506 U. The diesel locomotive has a frame having a first longitudinal support and a second longitudinal support, wherein the longitudinal supports are disposed so as to be laterally offset in relation to the travel direction. The diesel tank is disposed between the first longitudinal support and the second longitudinal support and below the longitudinal supports. The fuel tank delimits a tank interior space.

A vehicle structure of a diesel locomotive is known from CN 203876765 U, wherein the vehicle structure has a vehicle frame. The vehicle frame has a first longitudinal support and a second longitudinal support, wherein a fuel tank is disposed in the transverse direction between the first longitudinal support and the second longitudinal support.

A diesel locomotive having a vehicle body and a fuel tank is known from CN 200995684 Y. The fuel tank is disposed below the vehicle body. The fuel tank has a plurality of partition panels which extend in the vehicle longitudinal direction. The partition panels are disposed completely in the tank interior space.

A diesel locomotive having a vehicle frame and a fuel tank is known from CN 2752119 Y, wherein the vehicle frame has two longitudinal supports that run in parallel in the longitudinal direction. The vehicle tank in the transverse direction is disposed between the longitudinal supports of the vehicle frame. The longitudinal supports are free of interruptions.

SUMMARY OF THE INVENTION

It is an object of the invention to provide an improved rail vehicle.

This object is achieved by a rail vehicle having a longitudinal support and a fuel tank, wherein the fuel tank has a tank wall and at least one first support, the tank wall delimits a tank interior space for storing a fuel, the first support is connected to the tank wall at least in portions, the longitudinal support includes a first longitudinal support portion and a second longitudinal support portion that is disposed so as to be offset in the longitudinal direction of the rail vehicle, the fuel tank is disposed in the longitudinal direction between the first longitudinal support portion and the second longitudinal support portion, the first support is coupled to the first longitudinal support portion and the second longitudinal support portion, the first support at least in portions is disposed in the tank interior space in the longitudinal direction, the first support running in the longitudinal direction is disposed between the first longitudinal support portion and the second longitudinal support portion, and the first support is configured for fully transmitting a force acting between the first longitudinal support portion and the second longitudinal support portion in the longitudinal direction of the rail vehicle. Advantageous embodiments are set forth in the dependent claims.

It has been recognized that an improved fuel tank for a rail vehicle can be provided in that the rail vehicle has a first longitudinal support portion and a second longitudinal support portion of a longitudinal support, wherein the fuel tank has a tank wall and at least one first support, wherein the tank wall delimits a tank interior space for storing a fuel, wherein the first support is connected to the tank wall at least in portions, wherein the first support at least in portions is disposed in the tank interior space, wherein the first support is configured for transmitting a force between a first longitudinal support portion and a second longitudinal support portion of a longitudinal support of the rail vehicle.

This design embodiment has the advantage that an additional longitudinal support for connecting the first longitudinal support portion to the second longitudinal support portion can be dispensed with, and on account of the unitary construction mode of the fuel tank forces can be transmitted between the first longitudinal support portion and the second longitudinal support portion by way of the fuel tank. It is furthermore ensured on account thereof that the fuel tank has a particularly large storage volume for storing the fuel. The fuel tank furthermore has a particularly high level of crash safety. The fuel tank furthermore has a particularly low weight in comparison to the storage volume. The installation space requirement is also particularly favorable. Furthermore, a single-chamber tank is provided, such that additional control and regulation mechanisms and additional media lines can be dispensed with when compared to a multi-chamber tank.

In a further embodiment the first support has an upper brace. A mounting device for mounting a drive unit of the rail vehicle is disposed on the upper brace on a side of the upper brace that faces away from the tank interior space. A particularly low position of the center of gravity of the rail vehicle can be ensured on account thereof. Furthermore, a conveying height for conveying the fuel out of the fuel tank is minor.

In a further embodiment the upper brace has a first upper brace portion and at least one second upper brace portion, wherein the first upper brace portion is disposed so as to be more remote from the tank interior space than the second upper brace portion. The mounting device is disposed on the second upper brace portion. The position of the center of gravity of the drive unit can be further improved on account thereof.

In a further embodiment the first support comprises a web. The web comprises a first web portion, wherein the first web portion is disposed in the tank interior space. The tank wall has a tank base. The tank base delimits the tank interior space on the lower side. The first web portion is connected to the tank base. A particularly high rigidity of the tank wall in the region of the tank base can be ensured on account thereof.

In a further embodiment the web extends in the longitudinal direction. The upper brace is fastened to the web on the upper side. The upper brace is aligned so as to be transverse to the web.

In a further embodiment the first web portion in the tank interior space delimits a first tank interior space portion and a second tank interior space portion. An opening is provided in the first web portion. The opening in fluidic terms connects the first tank interior space portion to the second tank interior space portion. The surge behavior of the fuel in the tank interior space can be improved on account thereof. A controlled flow to a retrieval point of the fuel on the tank base is simultaneously ensured.

In a further embodiment the tank wall comprises a front tank side wall and a rear tank side wall. The front tank side wall and the rear tank side wall delimit the tank interior space in portions. The front tank side wall is disposed so as to be offset in relation to the rear tank side wall. The web is disposed between the front tank side wall and the rear tank side wall, wherein the web by way of a first longitudinal end is connected to the front tank side wall, and by way of a second longitudinal end is connected to the rear tank side wall. On account thereof, the fuel tank has a particularly high level of crash safety, in particular in the longitudinal direction.

In a further embodiment the tank wall has a tank upper side for delimiting the tank interior space on the upper side, wherein the web comprises a second web portion, wherein the second web portion is disposed outside the tank interior space and protrudes beyond the tank upper side. Stressing of the tank upper side is avoided on account thereof and the latter can be configured so as to be particularly thin-walled. Furthermore, a reliable introduction of force into the support is ensured by way of the second web portion.

In a further embodiment the tank upper side at least in portions is configured in the manner of a tub, and at least in portions delimits a catchment volume. In the event of any damage to the drive unit a potential leakage of liquids from the drive unit is reliably trapped by the catchment volume in this way.

In a further embodiment the fuel tank has a tank side support. The tank side support is disposed to as to be laterally offset in relation to the first support, wherein the tank side support laterally delimits the tank interior space.

At least one first tank transverse support is disposed between the tank side support and the first support, wherein the first tank transverse support connects the first support to the tank side support. On account thereof, particular forces in the event of a side impact on the fuel tank can be transmitted from the tank side support to the first support by way of the first tank transverse support, such that the fuel tank can support particularly high impact forces also in the event of a side impact.

In a further embodiment the first tank transverse support extends across an entire height of the tank interior space and at least in portions is connected on the upper side to the tank upper side and on the lower side to the tank base.

In a further embodiment the fuel tank has a second support and at least one second tank transverse support, wherein the second support is disposed so as to be laterally offset in relation to the first support, wherein the second tank transverse support is disposed between the first support and the second support, and connects the first support to the second support, wherein the first support and the second support are preferably of identical configuration. A multiplicity of components can be reduced in this way.

In a further embodiment the first tank transverse support and the second tank transverse support are disposed in a common plane. Additionally or alternatively, the first tank transverse support is disposed so as to be offset in the longitudinal direction in relation to the second tank transverse support. Additionally or alternatively, the first tank transverse support and/or the second tank transverse support are/is disposed so as to be perpendicular to the first support. Additionally or alternatively, the first tank transverse support and/or the second tank transverse support have/has an L-profile.

In a further embodiment the fuel tank comprises a connector support, wherein the connector support on the external side is connected to the tank wall, wherein the connector support tapers off by way of an increasing spacing from the tank wall.

In a further embodiment the rail vehicle has a longitudinal support and the fuel tank described above, wherein the longitudinal support comprises a first longitudinal support portion and a second longitudinal support portion that is disposed so as to be offset in the longitudinal direction, wherein the fuel tank is disposed between the first longitudinal support portion and the second longitudinal support portion, wherein the first support is coupled to the first longitudinal support portion and to the second longitudinal support portion, wherein the first support is configured for transmitting a force in the longitudinal direction of the rail vehicle between the first longitudinal support portion and the second longitudinal support portion. In particular, the first support herein can transmit a thrust and/or tensile force acting in the longitudinal direction of the rail vehicle between the first longitudinal support portion and the second longitudinal support portion.

BRIEF DESCRIPTION OF THE SEVERAL VIEWS OF THE DRAWING

The properties, features, and advantages of this invention described above, and the manner in which said properties, features, and advantages are achieved, will be understood more clearly and evidently in the context of the following description of the exemplary embodiments which will be explained in more detail in conjunction with the drawings in which:

FIG. 1 shows a perspective illustration of a rail vehicle 10.

DESCRIPTION OF THE INVENTION

Figure 1:
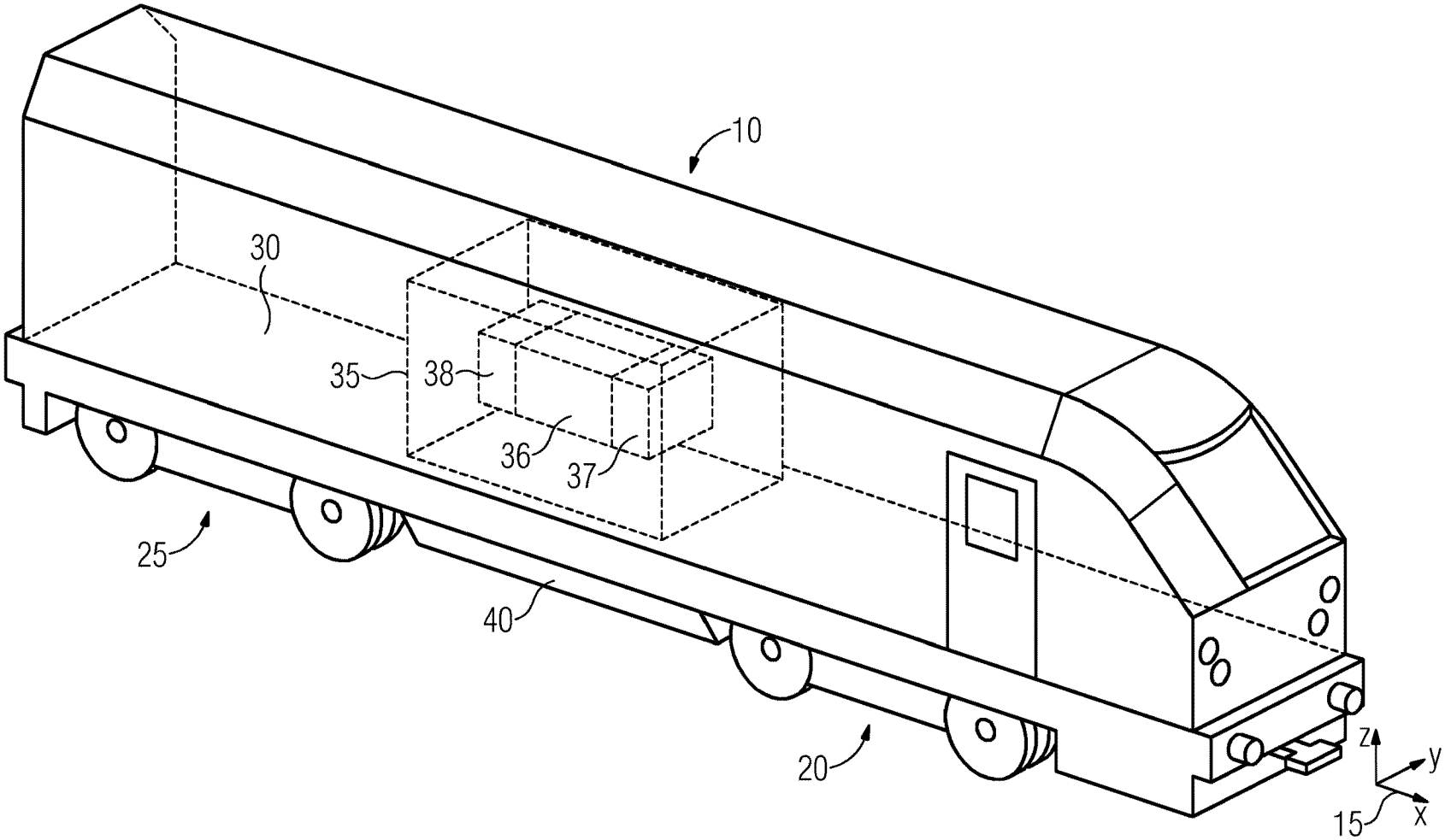
FIG. 1 shows a perspective illustration of a rail vehicle.

In order to facilitate the understanding of the figures reference hereunder is made to a coordinate system 15. The coordinate system 15 is configured as a right-handed trihedron and comprises an x-axis, a y-axis, and a z-axis. The x-axis herein is aligned in the travel direction and corresponds to a longitudinal direction of the rail vehicle 10. The y-axis is aligned in the transverse direction/lateral direction of the rail vehicle 10. The z-axis corresponds to a vertical direction of the rail vehicle 10. The z-axis runs counter to gravity.

The rail vehicle 10 can in particular be configured as a locomotive. The rail vehicle 10 can also be configured as a powered railcar or as a rail-bound car.

The rail vehicle 10 in an exemplary manner comprises a first truck 20, a second truck 25, a car body 30, a drive unit 35, and a fuel tank 40. The fuel tank 40 herein in an exemplary manner is disposed in the longitudinal direction in the undercarriage between the first truck 20 and the second truck 25. The fuel tank 40 extends substantially across the entire width (y-direction) of the rail vehicle 10.

The drive unit 35 in the embodiment in an exemplary manner is configured as a diesel-electric drive. The drive unit 35 in an exemplary manner comprises a drive motor 36, a generator 37, and a cooling system 38. The drive motor 36 in an exemplary manner is configured as a diesel engine and is coupled in a torque-fitting manner to the generator 37. The cooling system 38 serves for cooling the drive motor 36. Of course, other design embodiments of the drive unit 35 are also conceivable. The drive unit 35 is disposed substantially above the fuel tank 40. A fuel for the drive motor 36 is stored in the fuel tank 40.

In the case of a design embodiment of the rail vehicle 10 as a car, the drive unit 35 can be dispensed with and an apparatus, for example an air conditioning installation, can be provided instead, for example. The fuel tank 40 herein serves for storing a fuel of the apparatus.

Figure 2:
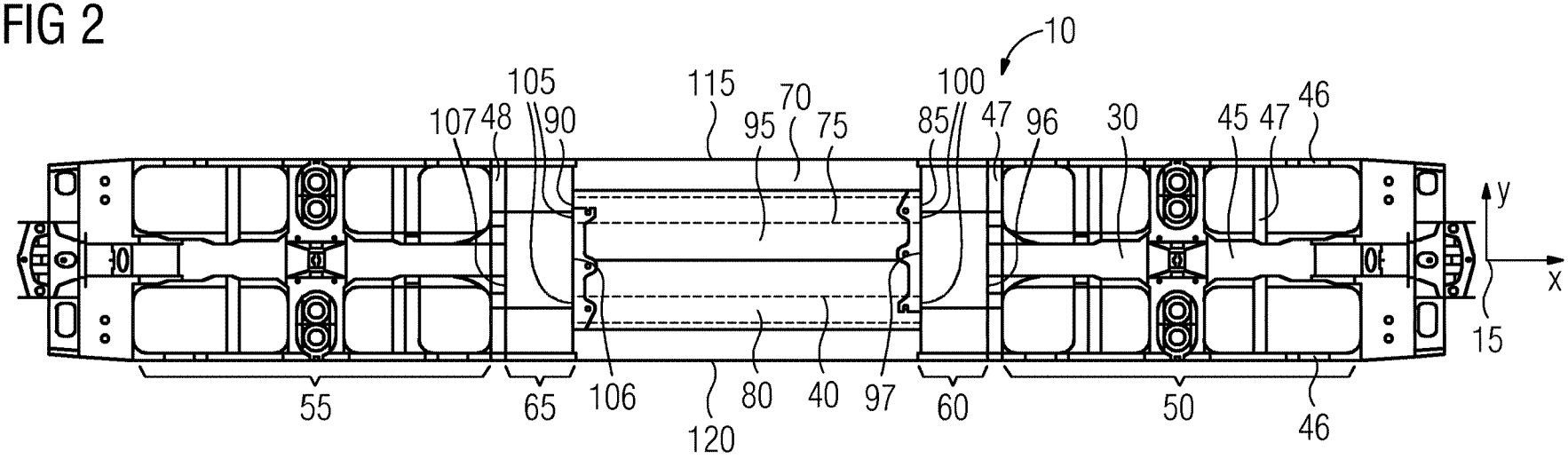
FIG. 2 shows a view of the lower side of the rail vehicle shown in FIG. 1.

FIG. 2 shows a view of the lower side of the rail vehicle 10 shown in FIG. 1. The illustration of various components, for example of the truck 20, 25, has been dispensed with for reasons of clarity.

The car body 30 comprises a longitudinal support 45. The longitudinal support 45 in the embodiment in an exemplary manner is disposed so as to be centric to the transverse direction of the rail vehicle 10. The longitudinal support 45 is also referred to as the central longitudinal support. The car body 30 in an exemplary manner can additionally have two longitudinal side supports 46, one first transverse support 47, and one second transverse support 48, wherein in each case one longitudinal side support 46 is disposed so as to be laterally offset in relation to the longitudinal support 45, said longitudinal side support 46 serving for laterally delimiting the rail vehicle 10, wherein the transverse support 47, 48 connects the longitudinal side support 46 to the longitudinal support 45. The transverse support 47, 48 in an exemplary manner is disposed so as to run in a y-z plane.

The longitudinal support 45 has a first longitudinal support portion 50 and a second longitudinal support portion 55. The first longitudinal support portion 50 is disposed so as to be spaced apart from the second longitudinal support portion 55 in the longitudinal direction (x-direction). The first transverse support 47 is disposed on a side of the first longitudinal support portion 50 that faces the fuel tank 40. The second transverse support 48 is disposed on a side of the second longitudinal support portion 55 that faces the fuel tank 40. The fuel tank 40 is disposed between the first transverse support 47 and the second transverse support 48.

The fuel tank 40 comprises a first connector support 60, a second connector support 65, a tank wall 70, a first support 75, and in an exemplary manner a second support 80. The number of supports 75, 80, and of connector supports 60, 65, is freely chosen.

The tank wall 70 comprises a front tank side wall 85 and a rear tank side wall 90. The front tank side wall 85 and the rear tank side wall 90 delimit a tank interior space 95 of the fuel tank 40 in the longitudinal direction.

The first connector support 60 at a first longitudinal end 96 is connected to the first longitudinal support portion 50 by way of the first transverse support 47. The first connector support 60 at a second longitudinal end 97 of the first connector support 60 is connected on the external side of the tank interior space 95 to the front tank side wall 85.

The first support 75 and the second support 80 are disposed so as to in portions run in the tank interior space 95 in the longitudinal direction between the front tank side wall 85 and the rear tank side wall 90. The support 75, 80 herein, by way of a first longitudinal end 100 inside the tank interior space 95, opposite the attachment point of the front tank side wall 85 to the first connector support 60, is connected to the front tank side wall 85. The support 75, 80 at a second longitudinal end 105, the latter being disposed so as to be offset in the longitudinal direction in relation to the first longitudinal end 100, in the embodiment in a rearward manner in the travel direction, inside the tank interior space 95 is connected to the rear tank side wall 90. The rear tank side wall 90 is connected to a first end 106 of the second connector support 65 on the external side of the tank interior space 95, opposite to the attachment point of the rear tank side wall 90 to the support 75, 80. The second connector support 65 in turn, at a second end 107, is connected to the second transverse support 48. The second transverse support 48 connects the second connector support 65 to the second longitudinal support portion 55.

The first longitudinal support portion 50 can be coupled, for example, to the first truck 20, and the second longitudinal support portion 55 can be coupled to the second truck 25. The rail vehicle 10 on account of the connection of the first longitudinal support portion 50 to the second longitudinal support portion 55 by way of the first transverse support 47, the first connector support 60, the support 75, 80, the second connector support 65 and the second transverse support 48 can be configured so as to be particularly compact. Furthermore, no further additional support is required in the region of the fuel tank 40 in order for an exchange of forces with a high load to be ensured between the first longitudinal support portion 50 and the second longitudinal support portion 55. In particular, the support 75, 80 alone can substantially fully transmit a thrust and/or tensile force acting in the longitudinal direction of the rail vehicle 10 (emanating, for example, from a train of cars coupled to the rail vehicle 10) between the first longitudinal support portion 50 and the second longitudinal support portion 55. Also, the forces, in terms of substantially tension or compression can be transmitted in a physically favorable manner in the support 75, 80, such that a thrust load on the support 75, 80 is avoided.

It is to be pointed out that it is also conceivable for the connector support 60, 65 and/or the transverse support 47, 48 to be dispensed with. The connector support 60, 65 and the transverse support 47, 48 in the embodiment serve for ensuring a particularly favorable force profile between the first longitudinal support portion 50, the support 75, 80, and the second longitudinal support portion 55.

Figure 3:
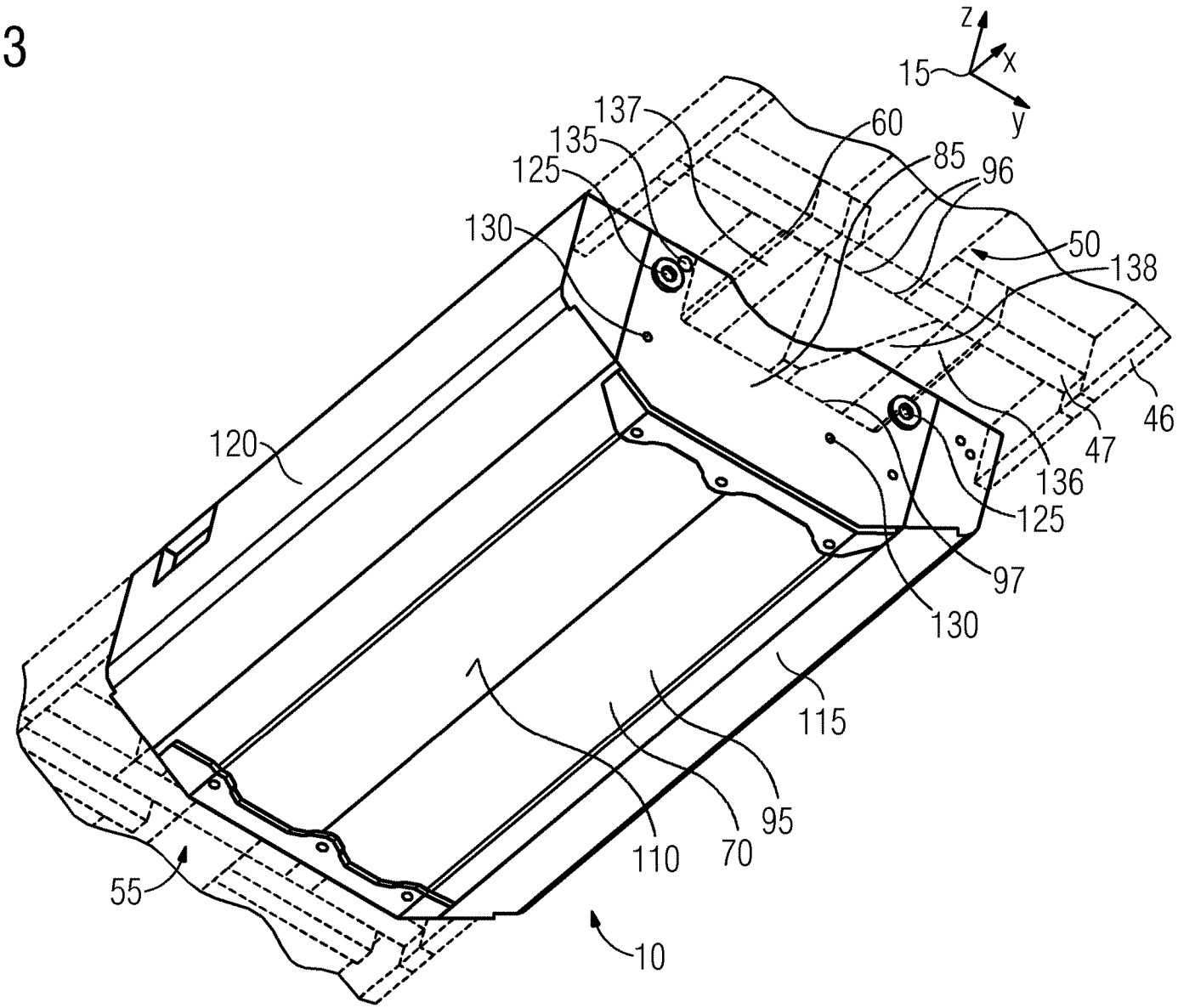
FIG. 3 shows a fragment of a perspective illustration of the rail vehicle shown in FIGS. 1 and 2.

FIG. 3 shows a fragment of a perspective illustration of the rail vehicle 10 shown in FIGS. 1 and 2. The tank wall 70 furthermore comprises a tank base 110. The tank base 110 delimits the tank interior space 95 of the fuel tank 40 on the lower side.

The fuel tank 40 furthermore has a first tank side support 115 and a second tank side support 120. The first tank side support 115 is disposed so as to be offset in the transverse direction in relation to the second tank side support 120. The first tank side support 115 and the second tank side support 120 herein laterally delimit the tank interior space 95. The tank side support 115, 120 is aligned with the longitudinal side support 46. The tank side support 115, 120 at the front longitudinal end thereof is connected to the front tank side wall 85, and at the rear longitudinal end of said tank side support 115, 120 is connected to the rear tank side wall 90. The tank side support 115, 120 on the lower side is connected to the tank base 110.

The fuel tank 40 furthermore has at least one ventilation installation 125. The ventilation installation 125 in the embodiment in an exemplary manner is disposed on the front tank side wall 85 and on the rear tank side wall 90 (not illustrated) so as to be laterally offset in relation to the connector support 60, 65.

A first opening 130 and at least one second opening 135 are provided in an exemplary manner in the front tank side wall 85. The opening 130, 135 is re-closable. For example, a cleaning device, for example a lance of a high-pressure cleaner, can be introduced into the tank interior space 95 through the first opening 130. The first opening 130 can also be used for checking the tank interior space 95 in the case of maintenance works. The second opening 135 can be utilized for separating oil from the fuel. The arrangement of the first and/or of the second opening 130, 135 herein is exemplary. The first and/or the second opening 130, 135 can be disposed in the front and/or the rear tank side wall 85, 90, depending on the application. In order for the tank wall 70 to be kept particularly rigid on the shelf face, the disposal of openings 130, 135 therein is dispensed with. A particularly high level of crash safety of the fuel tank 40 can be ensured on account thereof.

The connector support 60, 65 has a cross section that tapers off by way of an increasing spacing from the front tank side wall 85. The connector support 60, 65 has a first box portion 136 that runs in the longitudinal direction, and a second box portion 137 that runs in the longitudinal direction, each being disposed laterally of said connector support 60, 65 and each having a box-shaped cross section. The first box portion 136 on the lower side is connected to the second box portion 137 by a transverse web 138 that runs transversely (in the y-direction).

Figure 4:
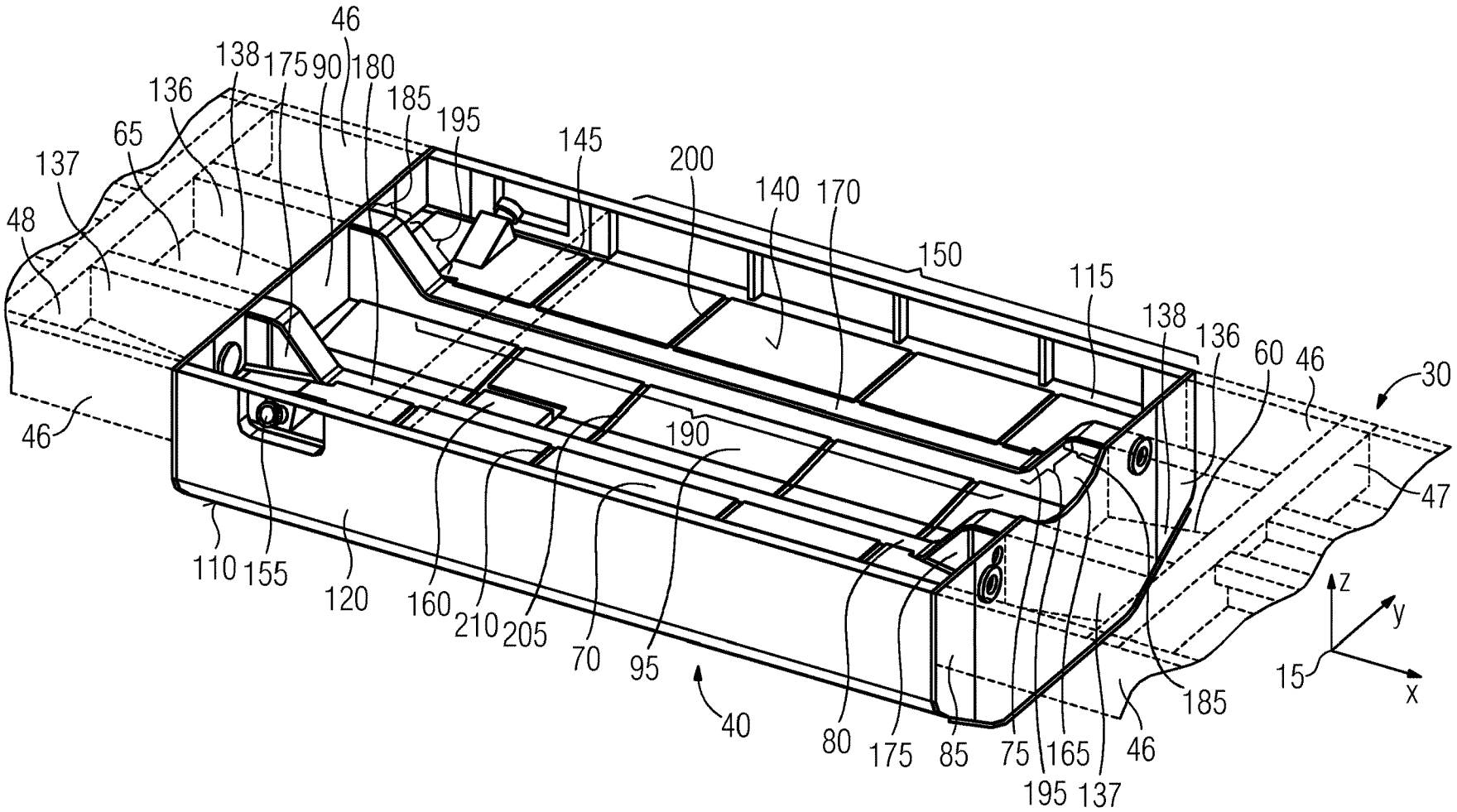
FIG. 4 a perspective view of a fuel tank of the rail vehicle shown in FIG. 1.

FIG. 4 shows a perspective view of the fuel tank 40.

The tank wall 70 has a tank upper side 140. The tank upper side 140 delimits the tank interior space 95 on the upper side. The tank upper side 140 is connected to the tank side support 115, 120 of the front tank side wall 85 and of the rear tank side wall 90.

The tank upper side 140 in the embodiment is configured in the manner of a tub. The tank upper side 140 in the center thereof herein is deeper than adjacent to the tank side supports 115, 120. The front tank side wall 85 and the rear tank side wall 90, as well as the tank side support 115, 120, protrude beyond the tank upper side 140. A bulkhead 145 (drawn in dashed lines in FIG. 4) can furthermore be provided. The bulkhead 145, conjointly with the tank side support 115, 120, the tank upper side 140, and the front tank side wall 85, delimits a catchment volume 150. The catchment volume 150 in the event of a defect of the drive unit 35 serves for trapping liquid leaking from the drive unit 35 and for preventing the liquid exiting to an environment. A maintenance opening 160 can furthermore be provided in the tank upper side 140.

A filling installation 155 for filling the tank interior space 95 with fuel is provided is between the rear tank side wall 90 and the bulkhead 145, for example.

The first support 75 and the second support 80 in the embodiment in an exemplary manner are of identical configuration. A dissimilar configuration of the support 75, 80 is also conceivable. The first support 75 has a first web 165 and a first upper brace 170. The second support 80 has a second web 175 and a second upper brace 180. The web 165, 175 is disposed so as to extend in the longitudinal direction (x-z plane) in a manner parallel with the tank side support 115, 120. The upper brace 170, 180 is fastened, preferably welded, to the web 165, 175 on the upper side. The upper brace 170, 180 herein is aligned so as to be perpendicular to the web 165, 175.

The upper brace 170, 180 has in each case one first upper brace portion 185, one second upper brace portion 190, and one third upper brace portion 195. The third upper brace portion 195 connects the first upper brace portion 185 to the second upper brace portion 190. The first upper brace portion 185 is disposed so as to be higher than the second upper brace portion 190. The third upper brace portion 195 is disposed so as to be inclined, preferably obliquely inclined, in relation to the first upper brace portion 185 and to the second upper brace portion 190. The first upper brace portion 180 is contiguous to the tank side wall 85, 90. The third upper brace portion 195 is disposed so as to be preferably centric in the longitudinal direction on the web 165, 175. Furthermore, the first brace portion 185 in an exemplary manner is disposed so as to run parallel with the third brace portion 195.

The fuel tank 40 has a first tank transverse support 200, a second tank transverse support 205, and at least one third tank transverse support 210.

The first tank transverse support 200 is disposed between the first tank side support 115 and the first support 75. The first tank transverse support 200 on the upper side is connected to the tank upper side 140, on the lower side to the tank base 110, laterally to the first tank side support 115 and to the first support 75.

The second tank transverse support 205 is disposed between the first support 75 and the second support 80. The second tank transverse support 205 herein on the lower side is connected, preferably welded, to the tank base 110, on the upper side to the tank upper side 140, and laterally to the first support 75 and to the second support 80.

The third tank transverse support 210 is disposed between the second tank side support 120 and the second support 80. The third tank transverse support 210 is laterally connected to the second support 80 and to the second tank side support 120, and on the upper side to the tank upper side 140 and on the lower side to the tank base 110.

The first tank transverse support 200 and the second tank transverse support 205, preferably also the third tank transverse support 210, are preferably disposed in a common plane, in particular in a common y-z plane. On account thereof, the fuel tank 40 is configured so as to be particularly rigid. Also, the first tank transverse support 200 and/or the second tank transverse support 205 and/or the third tank transverse support 210 can be disposed so as to be offset in the longitudinal direction in relation to the other tank transverse support. A slight offset offers in particular an advantage in terms of production in the welding of the tank transverse support 200, 205, 210 to the web 165, 175.

In the embodiment a plurality of first tank transverse supports 200, a plurality of second tank transverse supports 205, and a plurality of third tank transverse supports 210 are disposed in the longitudinal direction. The number of the tank transverse supports 200, 205, 210 is freely chosen. The number of the tank transverse supports 200, 205, 210 herein in an exemplary manner is in each case identical. A mutually dissimilar number of tank transverse supports 200, 205, 210 is also conceivable.

Figure 5:
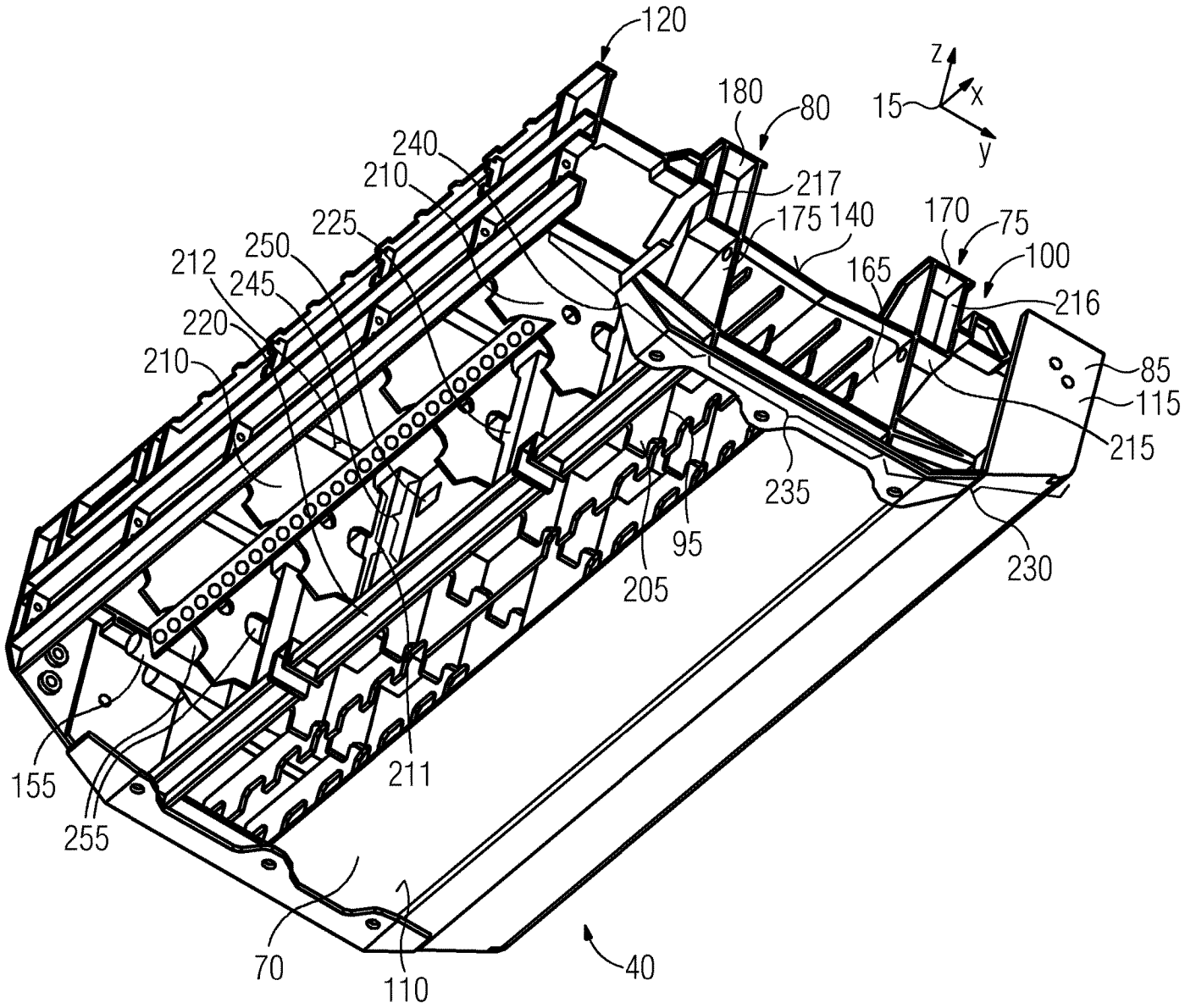
FIG. 5 shows a perspective view of the fuel tank shown in FIG. 4.

FIG. 5 shows a perspective view of the fuel tank 40. The tank wall 70 for reasons of clarity herein is in part not illustrated so as to be better able to illustrate the arrangement in the tank interior space 95.

The tank transverse support 200, 205, 210 in the embodiment is fabricated from an L-profile, wherein a long leg 211 of the L-profile extends across the entire height of the tank interior space 95, and a short leg 212 of the L-profile is connected to the tank upper side 140. The tank transverse support 200, 205, 210 can also have another profile.

A first reinforcement element 215 is provided so as to be contiguous to the first longitudinal end 100 and to the second longitudinal end 105 of the support 75, 80. The first reinforcement element 215 has an L-shaped profile and on the upper side is connected, preferably welded, to the upper brace 170, 180. The reinforcement element 215 is laterally connected to the web 165, 175. In the embodiment the first reinforcement element 215 is in each case disposed on the external side on the web 165, 175. The first reinforcement element 215 can also be disposed on the internal side of the web 165, 175. The first reinforcement element 215 conjointly with the first upper brace 170 and the first web 165 configures a third box portion 216 having a box-shaped cross section. A further first reinforcement element 215 is disposed on the second web 175 and on the second upper brace 180 in order for a fourth box portion 217 to be configured. The third and the fourth box portion 216, 217 reinforce the support 75, 80 in particular in the region of the front and of the rear tank side wall 115, 120. The third box portion 216 is disposed so as to be aligned with the first box portion 136, and the fourth box portion 217 is disposed so as to be aligned with the second box portion 137, such that an attachment point of the support 75, 80 to the connector support 60, 65 is configured so as to be particularly flexurally rigid, any damage to weld seams between the support 75, 80 and the front or the rear tank side wall 85, 90 being avoided.

The support 75, 80 furthermore has a second reinforcement element 220. The second reinforcement element 220, for example, has a U-profile and is disposed between a lower end of the web 165, 175 and the tank base 110. The second reinforcement element 220 in the longitudinal direction is aligned like the web 165, 175. The second reinforcement element 220 connects the web 165, 175 to the tank base 110.

The support 75, 80 additionally has a third reinforcement element 225. The third reinforcement element 225 extends in the z-direction and in an exemplary manner has a U-shaped profile. The third reinforcement element 225 is disposed laterally on a side of the web 165, 175 that faces the tank side support 115, 120. The first tank transverse support 200 and the third tank transverse support 210 are in each case laterally connected to the third reinforcement element 225.

The first web 165 partitions the tank interior space 95 into a first tank interior space portion 230 and a second tank interior space portion 235. The second web 175 laterally delimits the second tank interior space portion 235, and laterally delimits a third tank interior space portion 240. A first web portion 245 of the web 165, 175 herein is disposed in the tank interior space 95. The first web portion 245 is connected to the tank base 110 by way of the third reinforcement element 225.

In order for an exchange of fuel to be enabled between the tank interior space portions 230, 235, 240, a third opening 250 is provided in the first web portion 245. The third opening 250 in fluidic terms connects the first tank interior space portion 230 to the second tank interior space portion 235. The third opening 250 in the second web 175 in fluidic terms connects the second tank interior space portion 235 to the third tank interior space portion 240. The first web portion 245 herein assumes a function of a surge plate and improves a surge behavior of the fuel in the tank interior space 95 in the transverse direction. In particular, a plurality of third openings 250 which are disposed so as to be mutually spaced apart can be provided in the first web portion 245. It is particularly advantageous for the third opening 250 to be disposed so as to be contiguous to the tank base 110.

Additionally, at least one fourth opening 255 is disposed in the tank transverse support 200, 205, 210. The fourth opening 255 in fluidic terms interconnects two regions of the tank interior space portion 230, 235, 240 that are partitioned by the tank transverse support 200, 205, 210. The tank transverse support 200, 205, 210 herein improves a surge behavior of the fuel in the tank interior space 95 in the longitudinal direction.

The web 165, 175 extends across the entire length of the tank interior space 95 and herein is configured so as to be integral and so as to be materially integral. The web 165, 175 herein by way of the first longitudinal end 100 of the support 75, 80 is connected to the front tank side wall 85, and by way of the second longitudinal end 105 is connected to the rear tank side wall 90.

Figure 6:
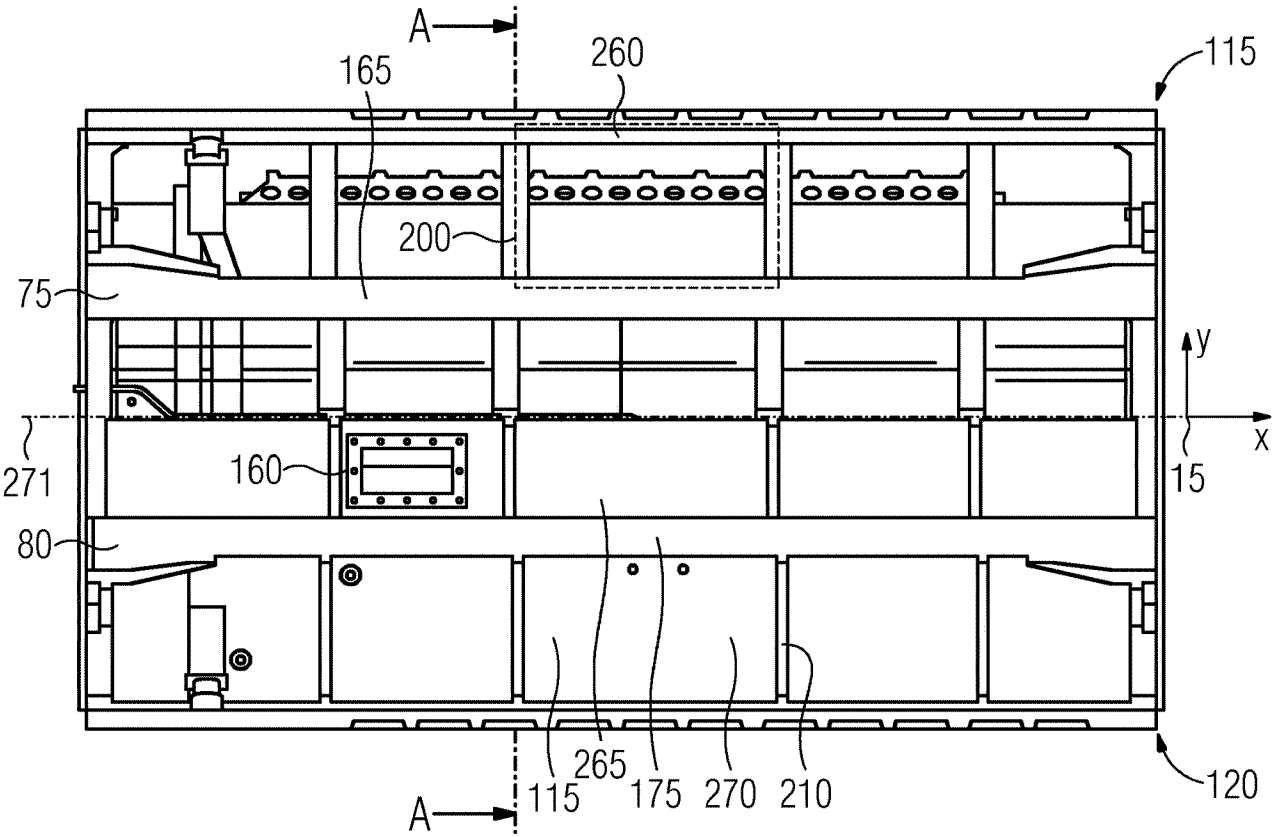
FIG. 6 shows a plan view of the fuel tank shown in FIGS. 4 and 5.

FIG. 6 shows a plan view of the fuel tank 40 shown in FIG. 5.

The tank upper side 140 has a first tank upper side element 260 (illustrated in dashed lines in FIG. 6), a second tank upper side element 265, and a third tank upper side element 270.

The first tank upper side element 260 in the transverse direction is disposed between the first tank side support 115 and the first web 165 of the first support 75. The first tank upper side element 260 on the lower side is connected in each case to two first tank transverse supports 200 that are disposed in an adjacent manner. In order for the first tank upper side element 260 to be able to be particularly readily welded to the first tank transverse support 200, the short leg 212 of the L-profile of the first tank transverse support 200 on the upper side is disposed below the first tank upper side element 260, and the first tank upper side element 260 is welded to the short leg 212.

The second tank upper side element 265 in the transverse direction is disposed between the first web 165 and the second web 175. It is particularly advantageous herein for the second tank transverse support 205 to also have a like L-profile, wherein the short leg 212 of the L-profile on the upper side is disposed below the second tank upper side element 265, wherein the second tank upper side element 265 is welded to the short leg 212 of the second tank transverse support 205.

The third tank upper side element 270 in the transverse direction is disposed between the second web 175 and the second tank side support 120. The third tank transverse support 210 is configured so as to be mirror-symmetrical in relation to a symmetry plane 271 which is disposed in the center of the vehicle, and in an exemplary manner likewise has an L-profile, wherein the short leg 212 of the L-profile is disposed below the third tank upper side element 270, and the third tank upper side element 270 is welded to in each case two third tank transverse supports 210 that are disposed in an adjacent manner.

Figure 7:
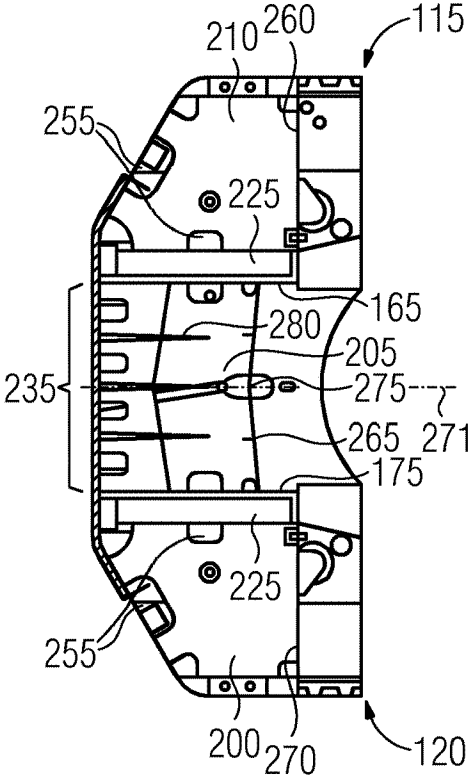
FIG. 7 shows a sectional view of the fuel tank shown in FIG. 6, along a section plane A-A shown in FIG. 6.

FIG. 7 shows a cross section along a section plane A-A shown in FIG. 6.

The first tank upper side element 260 and the third tank upper side element 270 in an exemplary manner are disposed in a common x-y plane and are thus aligned so as to be perpendicular to the web 165, 175. The second tank upper side element 265 is disposed below the first and the third tank upper side element 260, 270. The first tank upper side element 260 and the third tank upper side element 270 are configured so as to be planar, whereas the second tank upper side element 265 has a kink 270 which is disposed in the center of the vehicle.

Furthermore, a plurality of surge plates 280 which are disposed so as to be mutually offset in the transverse direction are provided in the second tank interior space portion 235 in order for a surge movement of the fuel to be further reduced also in the second tank interior portion 235. The surge plates 280 can of course be dispensed with. It is also conceivable for only one surge plate 280 to be provided.

Figure 8:
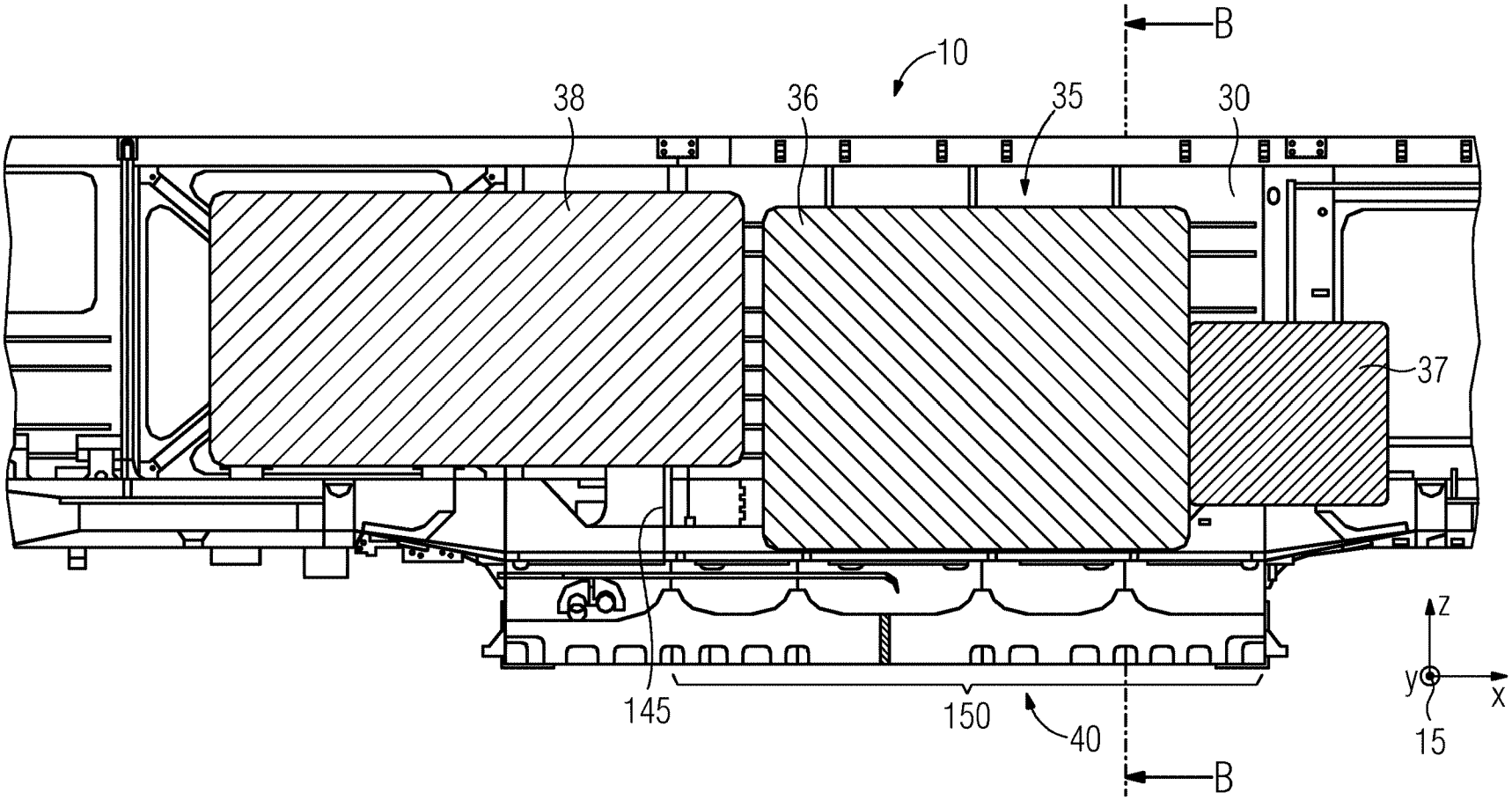
FIG. 8 shows a fragment of a longitudinal section through the rail vehicle shown in FIG. 1.

FIG. 8 shows a longitudinal section along a section plane that is disposed in the center of the vehicle and runs in an x-z plane. The drive unit 35 is disposed above the fuel tank 40. It is particularly advantageous herein for at least the drive motor 36 to be disposed completely above the catchment volume 150.

Figure 9:
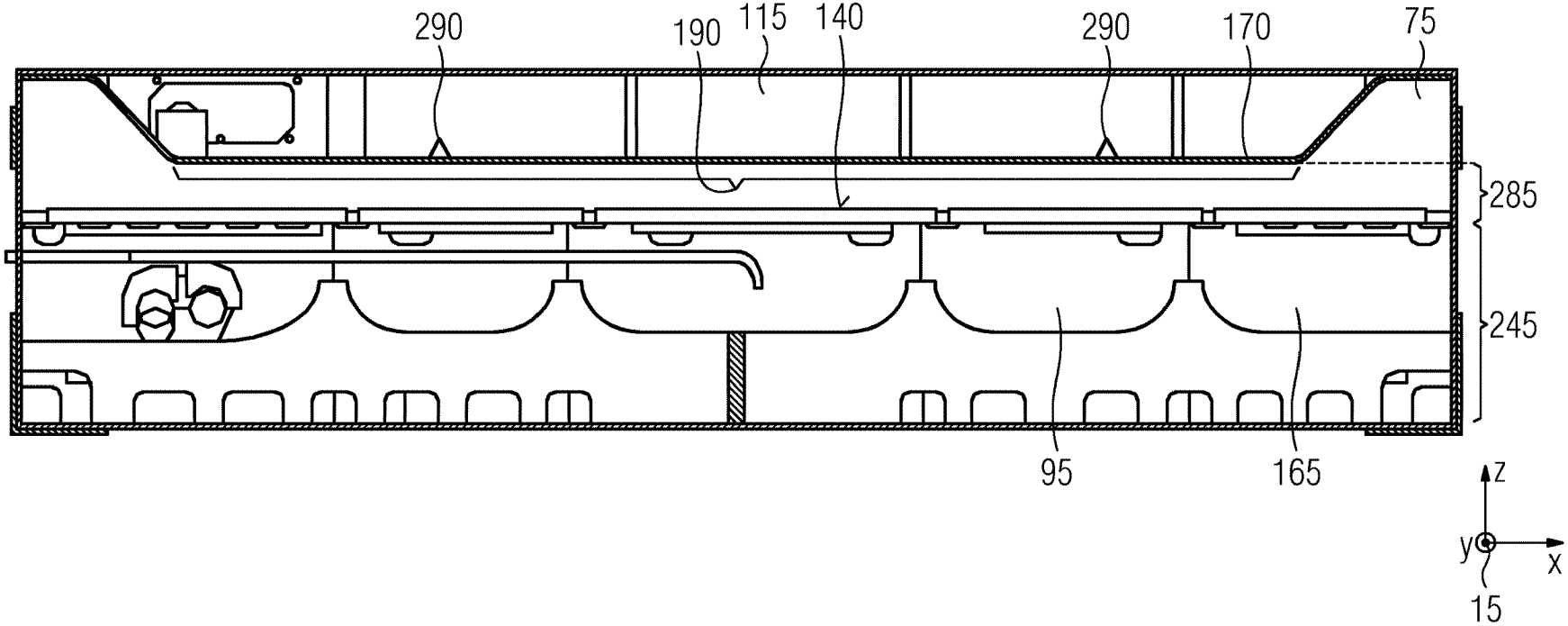
FIG. 9 shows a fragment of the longitudinal section shown in FIG. 8.

FIG. 9 shows a fragment of the longitudinal section, shown in FIG. 8, through the rail vehicle 10, wherein the illustration of the drive unit 35 has been dispensed with. The web 165, 175, besides the first web portion 245 which is disposed in the tank interior space 95, has a second web portion 285. The second web portion 285 is disposed outside the tank interior space 95 so as to be above the tank upper side 140. The upper brace 170, 180 is contiguous thereto above the second web portion 285. The second web portion 285 protrudes beyond the tank upper side 140. A mounting device 290 is disposed on a side of the upper brace 170, 180 that faces away from the tank interior space 95. The mounting device 290 herein supports the drive motor 36 and connects the drive motor 36 to the support 75, 80. On account of the arrangement of the mounting device 290 on the second upper brace portion 190, the drive motor 36 can be fastened so as to be particularly low. On account thereof the rail vehicle 10 has a position of the center of gravity that is particularly low and favorable.

Figure 10:
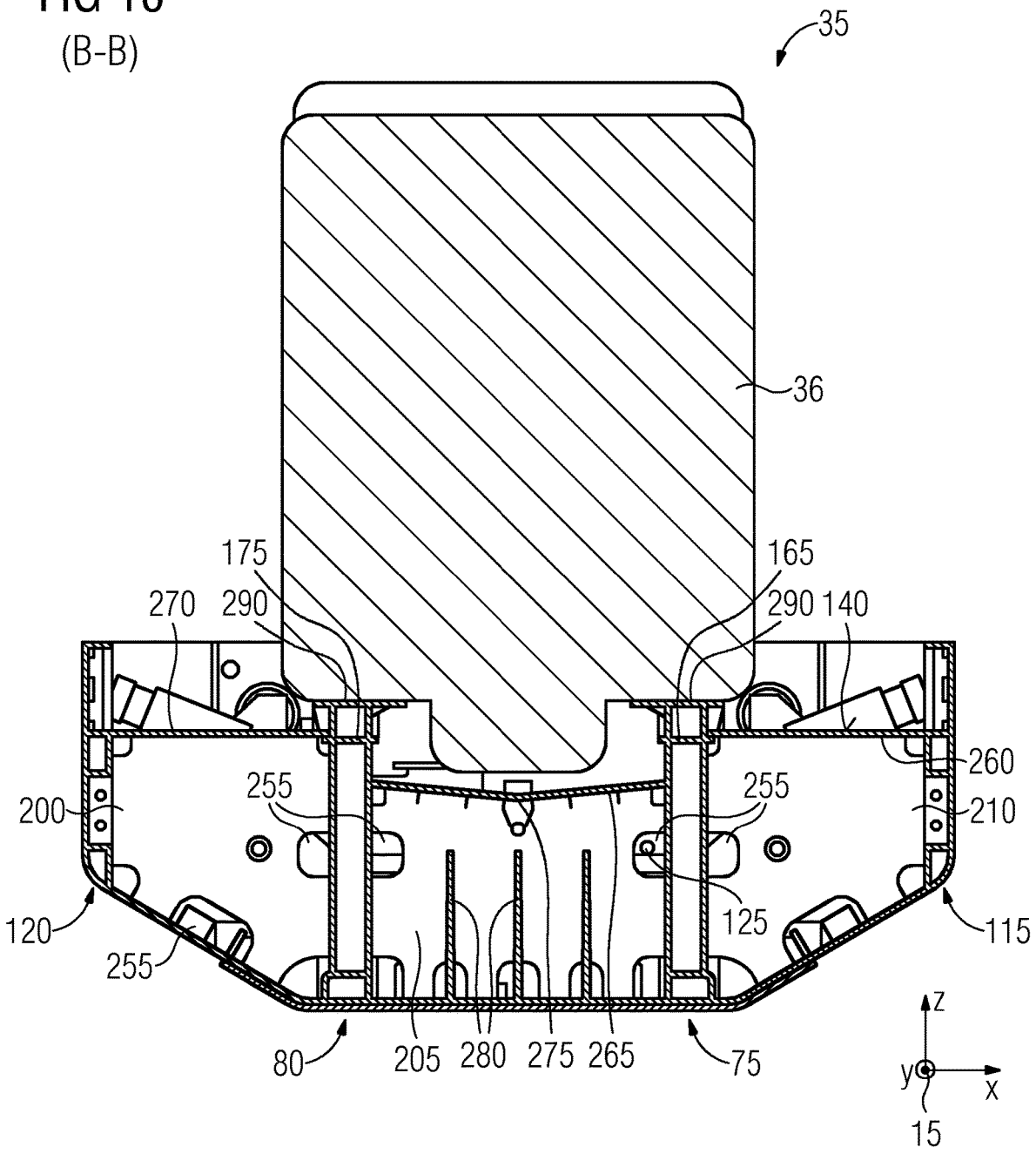
FIG. 10 shows a fragment of a sectional view through the rail vehicle shown in FIG. 8, along a section plane B-B shown in FIG. 8.

FIG. 10 shows a cross-section along a section plane B-B, shown in FIG. 8, through the rail vehicle 10. The illustration of the car body 30 has been dispensed with for reasons of clarity in FIG. 10.

The fourth opening 255 and the second opening 135 in the embodiment are in alignment and are disposed on a common axis which extends in the x-direction. On account thereof, a maintenance tool can be guided through the entire tank interior space 95 and the tank interior space 95 can be checked and/or cleaned, for example.

Forces from the drive unit 35, in particular from the drive motor 36, are introduced into the support 75, 80 through the mounting device 290, wherein the support 75, 80 further absorbs the forces in the longitudinal support portion 50, 55 by way of the connector support 60, 65, and the transverse support 47, 48. On account thereof, additional supports for transmitting tensile or support forces between the first longitudinal support portion 50 and the second longitudinal support portion 55 can be dispensed with. An additional support for fastening the drive unit 35, in particular for fastening the drive motor 36 and the generator 37, can also be dispensed with.

On account of the design embodiment described above of the rail vehicle 10, particularly high requirements set for a structural strength of the fuel tank 40, for example in the context of derailment scenarios in the event of a side impact of motor vehicles on the fuel tank 40, can be met. In particular, a high resistance to penetration of the tank wall 70, in particular in the region of the tank base 110, of the front and/or rear tank side wall 85, 90, or of the tank side support 115, 120 is avoided. On account of the design embodiment of the support 75, 80 in the manner of a double T by way of the upper brace 170, 180 and of the tank base 110, cavities which reduce an effective storage volume of the tank interior space 95 are avoided. On account thereof, the fuel tank 40 has a particularly large storage volume.

On account of the provision of the third and the fourth opening 250, 255, the tank transverse support 200, 205, 210 and the support 75, 80 effectively impede surge movements of the fuel in the tank interior space 95.

An additional lower brace on the support 75, 80 can be dispensed with by coupling the web 165, 175 to the tank base 110, on account of which the storage volume can be maximized.

Furthermore, the connections of the rail vehicle 10 described in FIGS. 1 to 10, in particular to the fuel tank 40, can be embodied as welded connections such that no further additional seal elements are to be provided. The forces can also be well absorbed.

It is to be pointed out that the tank wall 70, in particular the tank base 110 in the design embodiment is configured with a single wall. Of course, it is also conceivable for the tank wall 70 to be configured with multiple walls.

Furthermore, a high lateral rigidity in the transverse direction and a transmission of forces from the tank side support 115, 120 in the transverse direction to the support 75, 80 and by way of the support 75, 80 to the longitudinal support portion 50, 55, are ensured by way of the tank transverse supports 200, 205, 210. On account thereof, the fuel tank 40 in the event of a derailment of the rail vehicle 10 has a particularly favorable penetration behavior such that a leakage protection is guaranteed in the event of a crash. The fuel tank 40 also has a particularly high level of side impact safety. Furthermore, the rail vehicle 10 in the case of a derailment of the rail vehicle 10 can be supported on the fuel tank 40 without the latter being damaged herein.

The design embodiment described above of the fuel tank 40 furthermore enables a modular design embodiment of the rail vehicle 10. In summary, numerous requirements set for the storage volume, the structure, the crash safety, and the component carriers can be bundled in one functional group on account of the fuel tank 40 described above.

While the invention in detail has been more specifically illustrated and described by way of the preferred exemplary embodiment, the invention is not limited by the examples disclosed, and other variations can be derived therefrom by a person skilled in the art without departing from the scope of protection of the invention.

The invention claimed is:

1. A rail vehicle, comprising:

a drive unit of the rail vehicle;

a mounting device for mounting said drive unit;

a longitudinal support including a first longitudinal support portion and a second longitudinal support portion being mutually offset in a longitudinal direction of the rail vehicle;

a fuel tank disposed in said longitudinal direction between said first longitudinal support portion and said second longitudinal support portion, said fuel tank having a tank wall delimiting a tank interior space for storing a fuel and said fuel tank having at least one first support running in said longitudinal direction;

at least portions of said at least one first support being connected to said tank wall, at least portions of said at least one first support being disposed in said tank interior space in said longitudinal direction;

said at least one first support being disposed between and coupled to said first longitudinal support portion and said second longitudinal support portion, said at least one first support including an upper brace, said mounting device being disposed on said upper brace on a side of said upper brace facing away from said tank interior space; and said at least one first support being configured for transmitting a force acting between said first longitudinal support portion and said second longitudinal support portion in said longitudinal direction.

2. The rail vehicle according to claim 1, wherein:

said upper brace includes a first upper brace portion and at least one second upper brace portion;

said first upper brace portion is more remote from said tank interior space than said second upper brace portion; and said mounting device is disposed on said second upper brace portion.

3. The rail vehicle according to claim 2, wherein:

said at least one first support has a web;

said web includes a first web portion;

said first web portion is disposed in said tank interior space;

said tank wall has a tank base;

said tank base delimits said tank interior space on a lower side; and said first web portion is coupled to said tank base.

4. The rail vehicle according to claim 3, wherein:

said web extends in said longitudinal direction;

said upper brace is fastened to said web on an upper side; and said upper brace is aligned to be transverse to said web.

5. The rail vehicle according to claim 3, wherein:

said first web portion in said tank interior space delimits a first tank interior space portion and a second tank interior space portion;

said first web portion has at least one opening formed therein; and said opening in fluidic terms connects said first tank interior space portion to said second tank interior space portion.

6. The rail vehicle according to claim 3, wherein:

said tank wall includes a front tank side wall and a rear tank side wall;

said front tank side wall is offset relative to said rear tank side wall;

said front tank side wall and said rear tank side wall delimit portions of said tank interior space;

said web is disposed between said front tank side wall and said rear tank side wall; and said web includes a first longitudinal end connected to said front tank side wall and a second longitudinal end connected to said rear tank side wall.

7. The rail vehicle according to claim 3, wherein:

said tank wall has a tank upper side for delimiting said tank interior space on an upper side;

said web includes a second web portion; and said second web portion is disposed outside said tank interior space and protrudes beyond said tank upper side.

8. The rail vehicle according to claim 7, wherein at least portions of said tank upper side are configured as a tub, and at least portions of said tank upper side delimit a catchment volume.

9. The rail vehicle according to claim 7, wherein:

said fuel tank has a tank side support;

said tank side support is laterally offset relative to said at least one first support;

said tank side support laterally delimits said tank interior space;

at least one first tank transverse support is disposed between said tank side support and said at least one first support; and said first tank transverse support connects said at least one first support to said tank side support.

10. The rail vehicle according to claim 9, wherein said first tank transverse support extends across an entire height of said tank interior space and at least in portions is connected on an upper side to said tank upper side and on a lower side to said tank base.

11. The rail vehicle according to claim 9, which further comprises:

a second support and at least one second tank transverse support;

said second support being laterally offset relative to said at least one first support;

said second tank transverse support being disposed between said at least one first support and said second support; and said second tank transverse support connecting said at least one first support to said second support.

12. The rail vehicle according to claim 11, wherein said at least one first support and said second support are identically constructed.

13. The rail vehicle according to claim 11, wherein at least one of:

said first tank transverse support is at least one of disposed in a common plane with said second tank transverse support, or offset in said longitudinal direction relative to said second tank transverse support, or at least one of said first tank transverse support or said second tank transverse support is perpendicular to said at least one first support or has an L-shaped profile.

14. The rail vehicle according to claim 1, which further comprises a connector support having an external side connected to said tank wall, said connector support tapering off by way of an increasing spacing from said tank wall.

* * * * *